US011738241B2

(12) United States Patent
Small et al.

(10) Patent No.: US 11,738,241 B2
(45) Date of Patent: Aug. 29, 2023

(54) AUTOMATIC APPLICATION OF FINISH TO SPORTS BALL

(71) Applicant: Ball Mudder, LLC, Westlake, TX (US)

(72) Inventors: Philip W. Small, Westlake, TX (US); Fred Bellio, Westlake, TX (US)

( * ) Notice: Subject to any disclaimer, the term of this patent is extended or adjusted under 35 U.S.C. 154(b) by 0 days.

(21) Appl. No.: 17/910,326

(22) PCT Filed: Mar. 8, 2021

(86) PCT No.: PCT/US2021/021357

§ 371 (c)(1),
(2) Date: Sep. 8, 2022

(87) PCT Pub. No.: WO2021/183432

PCT Pub. Date: Sep. 16, 2021

(65) Prior Publication Data

US 2023/0135517 A1 May 4, 2023

Related U.S. Application Data

(60) Provisional application No. 63/052,775, filed on Jul. 16, 2020, provisional application No. 63/045,688, (Continued)

(51) Int. Cl.
*B05C 19/04* (2006.01)
*A63B 47/00* (2006.01)
(Continued)

(52) U.S. Cl.
CPC ..... *A63B 47/00* (2013.01); *A63B 45/00* (2013.01); *B05B 12/084* (2013.01);
(Continued)

(58) Field of Classification Search
None
See application file for complete search history.

(56) References Cited

U.S. PATENT DOCUMENTS 4,876,658 A 10/1989 Hass
2009/0214792 A1* 8/2009 Kruse ..... A63B 47/00 118/56

(Continued)

OTHER PUBLICATIONS

International Search Report and Written Opinion in International Appln. No. PCT/US2021/0213 57, dated May 20, 2021, 7 pages.

*Primary Examiner* — Alexander M Weddle
(74) *Attorney, Agent, or Firm* — Fish & Richardson P.C.

(57) ABSTRACT

The present disclosure involves systems for applying finishing treatment to balls. The system includes an arm that transports at least one ball through a plurality of stations. A first station includes a first actuator, which permits introduction of a ball into the arm. A second station includes a buffer, which buffs the surface of the ball and rotates the ball in place relative to the arm, a spray nozzle configured to apply treatment to the ball, and a camera configured to capture images of the ball. A third station includes an inspection camera that captures inspection images of the ball and a rotating plate configured to rotate the ball in place relative to the arm. A fourth station includes a second actuator, which ejects the ball from the arm.

24 Claims, 10 Drawing Sheets

Related U.S. Application Data filed on Jun. 29, 2020, provisional application No. 62/987,254, filed on Mar. 9, 2020.

(51) Int. Cl.

| | |
|---|---|
| ***A63B 47/04*** | (2006.01) |
| ***A63B 45/00*** | (2006.01) |
| ***B05B 13/02*** | (2006.01) |
| ***B05B 12/08*** | (2006.01) |
| ***B05D 3/12*** | (2006.01) |
| ***B05D 3/06*** | (2006.01) |
| ***B05D 5/06*** | (2006.01) |
| *A63B 37/14* | (2006.01) |
| *A63B 102/18* | (2015.01) |

(52) U.S. Cl.

CPC ..... *B05B 13/0242* (2013.01); *B05D 3/062* (2013.01); *B05D 3/12* (2013.01); *B05D 5/06* (2013.01); *A63B 37/14* (2013.01); *A63B 2102/18* (2015.10)

(56) References Cited

U.S. PATENT DOCUMENTS

| | | | |
|---|---|---|---|
| 2012/0237689 | A1 | 9/2012 | Lin et al. |
| 2015/0273281 | A1 | 10/2015 | Ohno et al. |
| 2015/0297954 | A1 | 10/2015 | Smith |

* cited by examiner

AUTOMATIC APPLICATION OF FINISH TO SPORTS BALL

CLAIM OF PRIORITY

This application is a National Stage Application under 35 U.S.C. § 371 and claims the benefit of International Application No. PCT/US2021/021357, filed Mar. 8, 2021, which claims priority to U.S. Provisional Patent Application No. 62/987,254 filed on Mar. 9, 2020, U.S. Provisional Patent Application No. 63/045,688 filed on Jun. 29, 2020, and U.S. Provisional Patent Application No. 63/052,775 filed on Jul. 16, 2020. The entire contents of the foregoing applications are hereby incorporated by reference.

BACKGROUND

In baseball, the balls are prepared for game by being rubbed with mud. This is done by hand by the home team's equipment managers. The mud improves the gripping properties of the baseball without significantly damaging the ball or darkening it too much and reducing its visibility to the hitter.

SUMMARY

The present disclosure involves systems, and an apparatus for applying finishing treatment to balls (e.g., sports balls). The system includes an arm that is configured to transport at least one ball through a plurality of stations. A first station includes a first actuator, which permits introduction of a ball into the arm. A second station includes a buffer, which buffs the surface of the ball and rotates the ball in place relative to the arm, a spray nozzle configured to apply treatment to the ball, and a camera configured to capture one or more images of the ball. A third station includes an inspection camera that captures one or more inspection images of the ball and a rotating plate configured to rotate the ball in place relative to the arm. A fourth station includes a second actuator, which ejects the ball from the arm. A controller determines a color of the ball based on the one or more images and the one or more inspection images, and operates the arm, the first actuator, the second actuator, the buffer spray nozzle, and the rotating plate.

Implementations can optionally include one or more of the following features.

In some instances, the system includes a housing that at least partially encloses the arm and the plurality of stations. An interior volume of the housing is illuminated with a light source. In some instances, the light source includes a UV-A illuminator that emits UV light in the range of 315-400 nm wavelengths. In some instances, a position sensor is mounted to the housing, which provides a reference position for the arm.

In some instances, the finishing treatment is a mixture of water and one or more additives.

In some instances, the finishing treatment is a suspension.

In some instances, the first station includes a UV-C illuminator that emits UV light in the range of 100-280 nm wavelengths and is configured to disinfect the ball.

In some instances, the arm includes cradles to hold balls, and is configured to hold at least six balls. In some implementations, the arm rotates about a vertical axis to transport the balls through the plurality of stations. In some implementations, the arm includes a flexible belt, which rotates about a horizontal axis to transport the balls through a plurality of stations.

In some instances, the plurality of stations includes a fifth station, which includes a third actuator. The third actuator ejects balls from the arm into a bass bin. In these instances, the second actuator is configured to eject the ball from the arm into a reject bin in response to the controller a color of the ball is unsatisfactory, and the controller actuates the third actuator when the ball is in the fifth station in response to a color of the ball being satisfactory.

In some instances, a labeler configured to print or imprint a label on the ball is positioned to print or imprint the label on the ball as the ball passes between the fourth station and the fifth station.

In some instances, the ball is a sports ball.

In some instances, the controller operates the camera and the inspection camera.

The present disclosure involves methods for applying finishing treatment to balls (e.g., sports balls). The methods including securing a ball in a holding arm configured to allow the ball to rotate about at least two perpendicular axes. Rotating the ball about a first axis, and about a second axis. Periodically spraying the finish to the ball. Buffing the ball. After a predetermined period, determining, from a sensor, a color of the ball. In response to determining the color of the ball meets a predetermined threshold, stop spraying and buffing the ball and printing or imprinting the ball with a certification.

In some instances, in response to determining the color of the ball does not meet the predetermined threshold, re-spraying and re-buffing the ball. Following re-spraying and re-buffing, determining a second color of the ball, and, in response to determining the second color of the ball does not meet the predetermined threshold, ejecting the ball into a reject bin.

In some instances prior to spraying the ball, the ball is irradiated with UV-C light in wavelengths of the range 100-280 nm to disinfect the ball.

In some instances, the ball is a sports ball.

In some instances, the finish is a mixture of water and one or more additives,

In some instances, the finish is a suspension.

In some instances, while determining the color of the ball, the ball is irradiated with a light source comprising a UV-A illuminator that emits UV light in the range of 315-400 nm wavelengths.

In some instances, the holding arm includes cradles to hold balls, and is configured to hold at least six balls.

The details of these and other aspects and embodiments of the present disclosure are set forth in the accompanying drawings and the description below. Other features, objects, and advantages of the disclosure will be apparent from the description and drawings, and from the description, drawings, and claims.

DETAILED DESCRIPTION

This disclosure describes a system for applying a finish or finishes to one or more balls in an automatic manner. In modern baseball, new balls are first rubbed with a mud compound prior to use in a game. In fact, a specific type of mud from the Delaware River is selected for finishing of all Major League Baseball balls. This process enhances the gripping surface of the ball to provide the pitcher more control over the pitch. Traditionally, the mud is applied to the baseballs by hand and by the home team prior to the game. Typically, and for each game, at least 240 new baseballs are prepared and finished with mud prior to their use.

This disclosure describes a system for automatically treating balls with finishing product, for example, Lena Blackburne Baseball Rubbing Mud. In some instances, the system can assess each ball during and after application of the finishing product, with the system ensuring consistent results, and thus, balls, are provided across each game. To provide for long-term quality control and tracking, the system may be able to apply a print or imprint to the balls prior to putting those balls into play.

The described solution is advantageous in that it provides a consistent finish to the balls, as opposed to the current solution where various equipment managers apply the finish, and who may apply the finish inconsistently from ball to ball, manager to manager, and stadium to stadium. Additionally, because each ball is inspected by the system, defective balls, or balls which are not appropriately finished, can be automatically separated from balls that are suitable for the game. Each ball that is successfully finished can have a certification (e.g., a serial number, date, etc.) printed or imprinted on it that can identify when and where the ball was finished. The system can further provide increased flexibility and consistency in the finishing substance. For example, mud can be mixed with water in a controlled ratio, which can be consistent across different teams and/or different sessions of finishing balls. The treatment and results of the balls can further be recorded, and in some cases, communicated to a remote server. Those results can be collected and compared from the different teams and over time, which can provide further insights into the ball finishing process, including its effect on the game and in-game performance.

Figure 1:
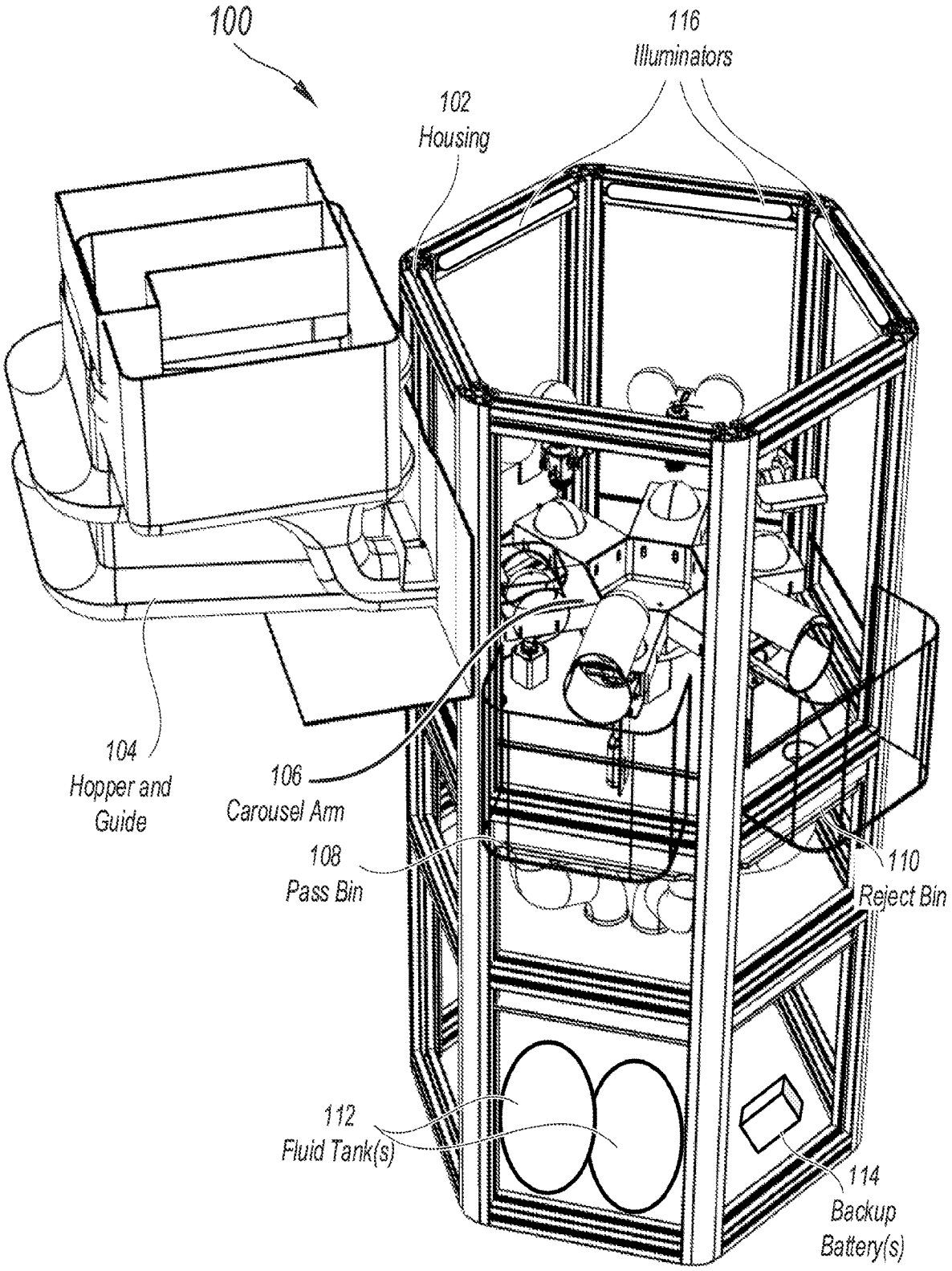
FIG. 1 is a perspective view of an example ball processing system.

Turning to the illustrated example implementation, FIG. 1 is a perspective view of an example ball processing system 100. Some structural components have been removed for clarity of presentation. The ball processing system includes a housing 102, a hopper and guide 104, carousel arm 106, pass bin 108, reject bin 110, one or more fluid tanks 112, one or more backup batteries 114, and one or more illuminators 116.

The housing 102 is a structural component which contains a portion of the processing system and provides a controlled environment for the processing of the balls. While illustrated as having transparent walls for clarity, the housing 102 can be opaque and consistent internal lighting can be provided by one or more illuminators 116. The illuminators 116 can be LEDs or other light sources. In some implementations the illuminators provide adjustable levels of light at different wavelengths (e.g., adjustable red, green, and blue intensities), as well as providing adjustable UV-A emissions. In some implementations, the amount and hue of the light provided by the illuminators 116 is automatically adjusted by a controller (not shown) based on inputs from one or more sensors (e.g., cameras as described with reference to FIG. 2 below). The housing 102 can be constructed of any suitable material (e.g., aluminum, steel, fiberglass, plastic, etc.) and can include one or more viewing windows or inspection doors (not shown), or alternatively, the entire housing 102 or significant portions thereof may be translucent or partially see-through.

A hopper and guide 104 is mounted to the housing 102, and allows for balls to be loaded into the system, guiding them onto the carousel arm 106. The carousel arm 106 has a cradle positioned at the first processing station, which is described in greater detail below with regard to FIG. 2.

A pass bin 108 and a reject bin 110 are mounted to the side of the housing 102 to collect balls following inspection during processing. Balls that satisfy a set of evaluation criteria can be fed to the pass bin 108, while balls that do not satisfy or otherwise fail the set of evaluation criteria can be fed to the fail bin 110. Portions of the pass bin 108 and reject bin 110 are removed for clarity. In general, the pass bin 108 and reject bin 110 encompass any suitable container(s) for retaining balls that have been processed by the ball processing system 100. In some implementations, pass bin 108 is sized to hold 240 or more finished baseballs, although smaller or larger sizes can be used.

Fluid tanks 112 contain finishing fluids used in the processing system 100. In some implementations, the fluid tanks 112 contain pressurized finishing fluid (e.g., a mud/water mixture) which is transported to the processing stations via one or more hoses (not shown). In some implementations, some of the multiple fluid tanks 112 contain different substances. For example, one tank may contain water and another may contain mud, where the mud is combined with the water when it is sprayed onto a ball being finished. The nozzles are described in more detail below with regard to FIG. 2. In some implementations, the processing system 100 includes a fitting to be supplied with water from an external source (e.g., a tap or hose bib). In some implementations, the fluid tanks 112 are not pressurized, but include a pump (e.g., an electric pump) which provides pressurized fluid from the fluid tanks to the nozzles above.

The ball processing system 100 can be supplied with power via an external source. For example, a 110 VAC 60 Hz electrical power outlet, or in another example, a 240V 50 Hz source. In some implementations, the system 100 includes one or more backup batteries 114, which can provide power to process a certain number of ball (e.g., 240) without any external power source. The batteries 114 can be rechargeable and can be configured to automatically begin recharging when the system is plugged in. The batteries can be lithium ion (Li-Ion), nickel metal hydride (NiMH), Lead-acid, or any other suitable battery type. In some implementations, the entire ball processing system 100 is portable, and, can rely entirely on fluid tanks 112 and batteries 114 to provide everything necessary to process 240 or more balls. In some implementations, the processing system is mounted on wheels, to provide portability.

Figure 2:
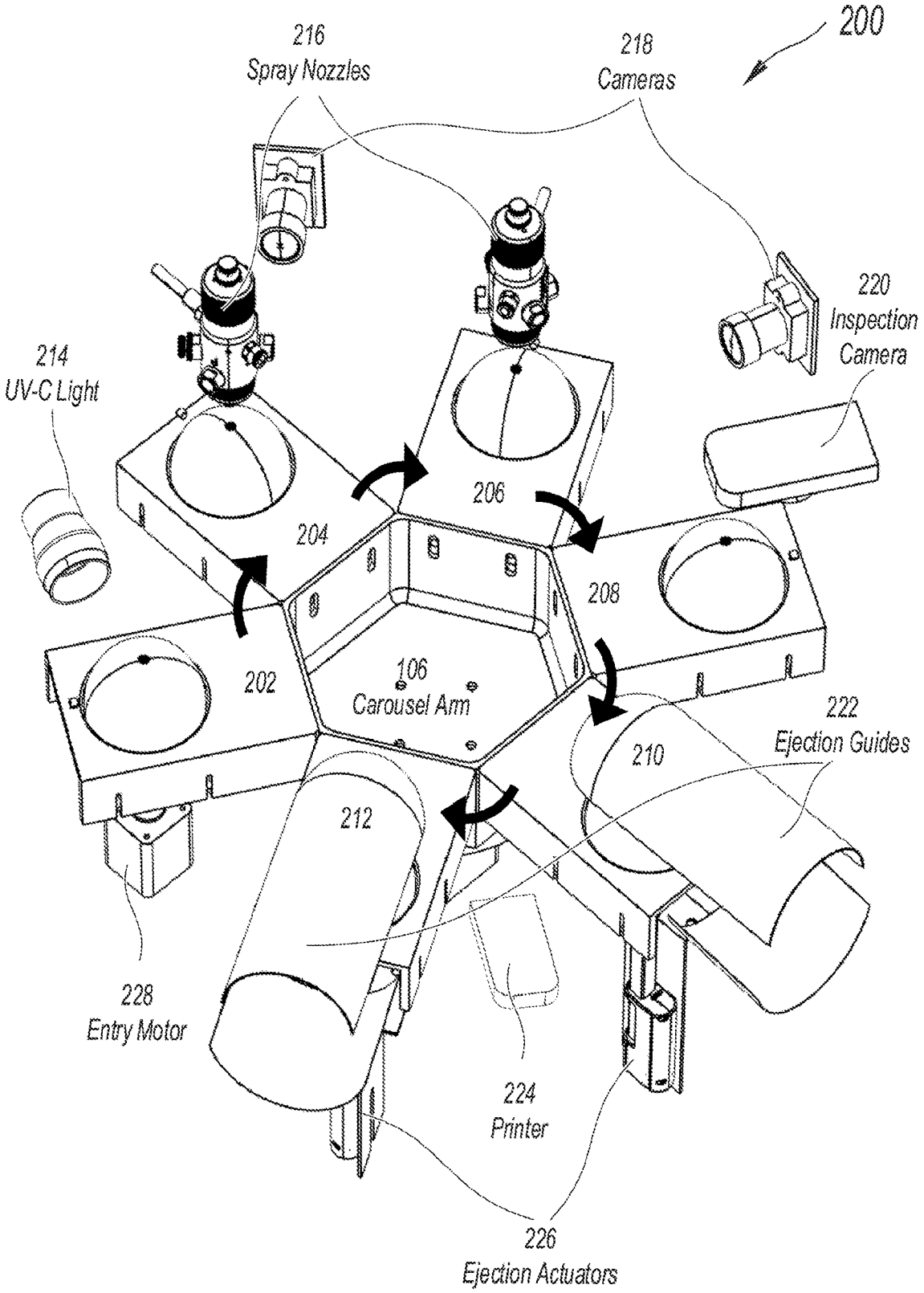
FIG. 2 is a top perspective view of a carousel arm and ball treatment stations.

FIG. 2 depicts a top perspective view of a carousel arm and ball treatment stations. In the illustrated example, there are six processing stations, 202, 204, 206, 208, 210, and 212. The carousel arm 106 is capable of holding six balls, one in each station simultaneously.

The first station 202 is where the balls enter the carousel arm 106. An entry motor 228 operates to rotate the ball in its cradle in the carousel arm 106. In the illustrated implementations, the carousel arm 106 has a star-shaped form, with six cradles, configured to hold six balls. The entry motor 228 can also raise and lower, or otherwise operate a gate to allow balls to enter the first station 202 from a hopper of feed guide (e.g., hopper and guide 104 as described with reference to FIG. 1). A pressure sensor, range sensor, or other detector can sense when a baseball is present in the first station. Optionally, once a ball has been introduced to the first station 202 and is held by the carousel arm 106, it can be rotated by the entry motor 228 while it is irradiated by a UV-C light 214. The UV-C light can emit antimicrobial frequencies of light (e.g., between 100 nm and 280 nm wavelengths) which disinfects or reduces the microbe population present on the ball. After a predetermined amount of time, or number of rotations, or after a set of criteria is met (e.g., the balls in stations 204 and 206 have achieved the desired color), the carousel arm 106 rotates (clockwise in the illustrated example) to deliver each ball to its next corresponding station.

At the second station 204, the ball is rapidly rotated and buffed using a buffer plate from below (described in more detail with respect to FIG. 3). The rotating ball is sprayed with a finishing substance by one or more spray nozzles 216. The spray nozzles 216 receive one or more pressurized fluids (e.g., fluids from fluid tanks 112) and apply the fluids to the ball. The spray nozzles can include a valve (e.g., a solenoid vale) that opens to allow the pressurized fluid to spray onto the ball. The valve can be remotely controlled by a controller to spray a predetermined quantity of fluid, or to spray until a desired color is achieved. In some implementations, the spray nozzle 216 receives multiple pressurized fluids, and can selectively spray each fluid, or a mixture thereof. For example, a spray nozzle 216 can have three input lines, one carrying mud, one carrying water, and one carrying air. In this example, with a solenoid valve in a first position, a mixture of mud and water can be sprayed. With the solenoid valve in a second position, only water is sprayed, and when the solenoid valve is moved to a third position, air is sprayed. In some implementations, the valve is continuously adjustable between the positions, allowing for different ratios of mud/water/air based on its position. In some implementations, multiple valves are used. For example, one servo-driven throttle valve for each fluid received at the nozzle.

One or more cameras 218 can record images or video of the ball as it is sprayed and buffed. The cameras 218 can be used to measure a color of the ball. For example, a hue, saturation, and/or intensity can be determined for the ball, some or all of which can be analyzed by a controller in order to determine if the ball has had the appropriate amount of finish applied. In some implementations, a machine learning algorithm or computer vision algorithm can be used to determine if the ball is at the desired level of finish. In some implementations, a final desired color is determined, and the ball is considered to be completed at the second station 204 when it achieves between 80% and 90% of the final desired color. In some implementations, the carousel arm 106 rocks back and forth during application of spray and buffing to encourage uniform spray and buffing of the ball in the second station 204 and the third station 206.

Figure 3:
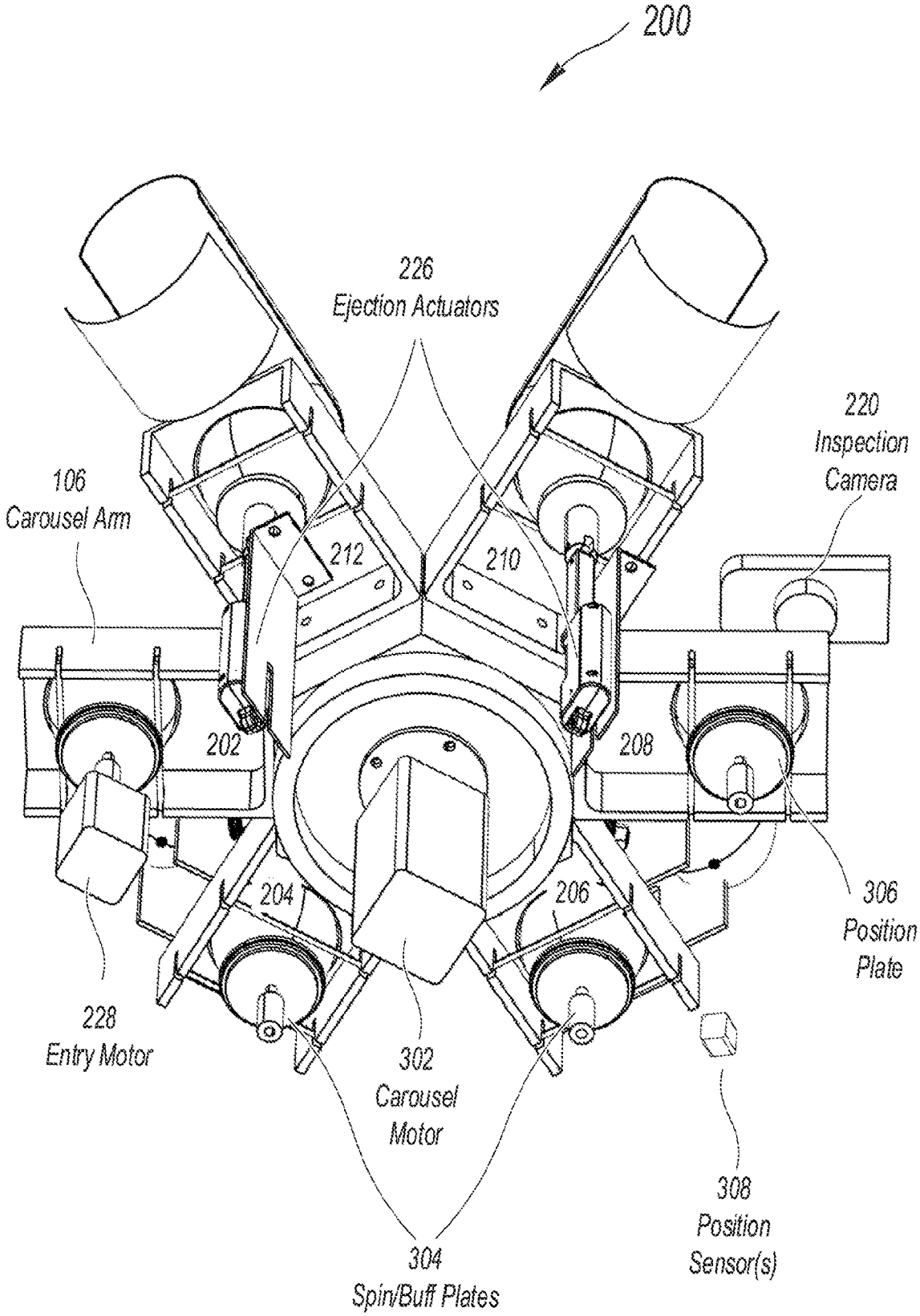
FIG. 3 is a bottom perspective view of a carousel arm and ball treatment stations.

The third station 206 is similar to the second station 204, with one or more spray nozzles 216 and one or more cameras 218, as well as one or more buffing plates (illustrated in FIG. 3). In some implementations, the third station 206 is used to finalize the finish of the ball, bringing it up to its final color (e.g., 95%-105% of the desired color). In some implementations, the third station 206 performs a drying cycle, blowing air over the ball to dry it before the next station.

The fourth station 208 performs a final positioning and inspection of the ball. An inspection camera 220 is positioned over the ball. The inspection camera 220 performs a final verification that the finish of the ball is within specification. Additionally, a rotation plate (illustrated in FIG. 3) can rotate and position the ball with a vacant portion of the ball (e.g., no laces, decals, or labels) facing upward for future printing/imprinting. The inspection camera 220 can verify the vacant portion of the ball is within a specified color range (e.g., between 90% and 110% of the desired color) and verify that the presented vacant portion of the ball is not the "sweet spot" of the ball, which is a region of the ball where it is desirable to place autographs or other labels. In some implementations, the inspection camera 220 is physically identical to the cameras 218, differing only in its positioning within the system 200. In some implementations, inspection camera 220 features a higher or lower resolution, or more sensitive detector. Once inspection and positioning is complete and the processing of balls in other stations is complete, the carousel arm 106 can rotate again, moving each ball to its next station.

The fifth station 210 is a rejection station. If the ball does not pass inspection in the fifth station 208, then an ejection actuator 226 can press the ball up out of its cradle and into ejection guide 222, where the ball will then fall out of the processing system 200. In some implementations, the ball will fall into a reject bin as illustrated and described with reference to FIG. 1 (i.e., reject bin 110). If the ball passes inspection, the ejection actuator 226 can remain unactuated, allowing the ball to pass to the sixth station 212 during the next rotation of the carousel arm 106. Ejection actuators 226 can be linear actuators, rotary actuators on a linkage, or any suitable mechanism for ejecting the ball. In some implementations, the ejection actuators 226 are Actuonix® PQ12 series linear actuators.

A printer 224 is located between the fifth station 210 and the sixth station 212. The printer 224 places a certification mark on the balls that have passed. The certification mark can be placed in the vacant portion of the ball that was positioned upright in the fourth station 208. In some implementations, the printer 224 imprints the balls, while in others the printer 224 prints on the balls. The printer 224 can use ink, pressure, heat, or any other suitable marking method to place the certification mark. In some implementations, the printer 224 prints the certification mark using ink that is invisible unless illuminated under a UV light, such as a black light. The certification mark can include a serial number, logo, and additional data. For example, the certification mark can include two codes, such as a first 3-digit code (e.g., MLB) and a second 9-digit serial number (e.g., 005282010). In some implementations, the certification can include a date, location, lot number, device number, or other information relating to the ball finishing process or related equipment.

The sixth station 212 is where balls that have passed the inspection and positioning and have received a certification mark are ejected using an ejection actuator 226 into a pass bin (e.g., pass bin 108 as described with reference to FIG. 1).

FIG. 3 is a bottom perspective view of a carousel arm and ball treatment stations. In FIG. 3, the carousel motor 302, which rotates the carousel arm 106, is visible. The carousel motor 302 can be a stepper motor, servomotor, DC motor, AC motor, or any suitable electric motor for rotating the carousel arm 106. In some implementations, the carousel motor 302 provides bi-directional movement of the carousel arm 106 and provides for precise positioning of each ball in the carousel arm 106 at its respective station.

Spin/buff plates 304 can be rotating plates that both spin the ball in the carousel arm 106 and buff the surface of the ball to apply the finish, which is sprayed onto the ball. In some implementations, the spin/buff plates 304 rotate between 2,000 and 20,000 revolutions per minute (RPM) in order to "rub" the ball. The spin/buff plates 304 can have removable/replaceable buffers, which can be replaced or refurbished as they wear. In some implementations, at the first station 202, the entry motor 228 rotates at approximately 3,000 RPM while the ball is disinfected. The spin/buff plates 304 can rotate at 12,000 to 15,000 RPM to provide adequate buffing and ensure the entire surface of the ball is treated. At the fourth station 208, a position plate 306 rotates the ball until a vacant portion of the ball is facing upward as detected by the inspection camera 220. In some implementations, the position plate 306 rotates at approximately 5,000 RPM. In some implementations, the position plate 306 is coated with a high friction surface (e.g., rubberized) to grip the ball and ensure it rapidly stops rotating when the position plate 306 stops rotating.

One or more position sensors 308 are located in the processing system 200. They can be mounted to the housing (as described with reference to FIG. 1) or on the carousel arm 106 itself. In some implementations, the position sensors 308 are magnetic Hall Effect sensors or reed switches, which indicate the presence of the carousel arm or a structural component in close proximity to the position sensor 308. The position sensor 308 is used as a reference to ensure the carousel arm 106 is correctly positioned and that each ball is in its appropriate station. In some implementations, a position sensor 308 is integrated into the carousel motor 302, for example, as an encoder, which ensures precise position control of the carousel motor 302 is possible.

Figure 4:
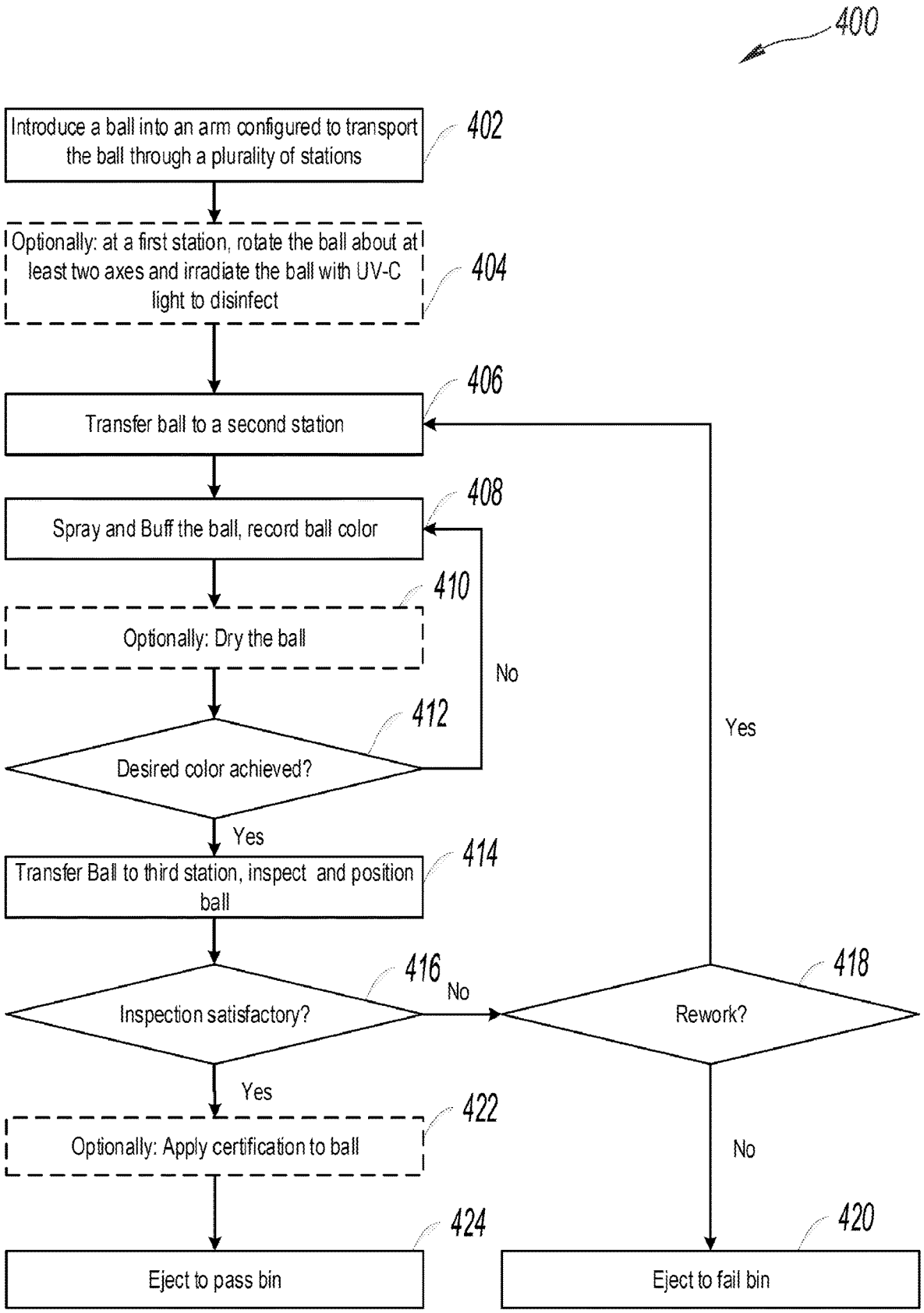
FIG. 4 is a flowchart describing an example process for applying finish to balls.

FIG. 4 is a flowchart describing an example process for applying finish to balls. FIG. 4 is an example process illustrated from the point of view of a ball processing system, such as processing system 100 of FIG. 1. However, it will be understood that process 400 may be performed, for example, by any other suitable system, environment, software, and hardware, or a combination of systems, environments, software, and hardware as appropriate. In some instances, process 400 may be performed by a plurality of connected components or systems. Any suitable system(s), architecture(s), or application(s) can be used to perform the illustrated operations.

At 402, a ball is introduced into an arm that transports the ball through a plurality of stations. In some implementations, the arm is similar to the carousel arm 106 as described with reference to FIG. 1. In some implementations, the arm is a conveyor belt, or other device suitable for receiving balls and transporting them through stations to be processed. The ball can be a baseball, football, soccer ball, basketball, or other sports ball, which needs to be finished. In some implementations, the ball is a baseball, and the finishing process is applying a mud mixture to the ball in order to enhance its grip and color.

At 404, optionally, the ball is rotated and irradiated with a UV-C light to disinfect. A rotating plate positioned below the ball in the first station can cause the ball to rotate within its cradle in the arm. One or more UV-C lights (e.g., Seoul Viosys CA3535 Series lights) can emit light at wavelengths between 100 nm and 280 nm in order to kill microbes on the surface of the ball.

At 406, the ball is transferred to a second station. In some implementations, the arm rotates about a central axis and the stations are arranged in a circular pattern about the axis of rotation of the arm. In some implementations, the stations are arranged in a linear pattern and the arm translates the ball in a line from station to station.

At 408, the ball is sprayed and buffed, and a color of the ball is recorded. These three operations can be completed simultaneously. For example, a buffer plate can buff and rotate the ball in its cradle of the arm. While being buffed, a spray nozzle can apply the finish periodically. A camera can record still images or video, which can be used to analyze the uniformity and color of the finish as it is applied to the ball. In some implementations, spraying and buffing can continue while process 400 proceeds directly to 412, where it is determined if a desired color has been achieved. In some implementations, spraying and buffing is done for a predetermined time, or to a predetermined amount, at which point process 400 proceeds to 410, where the ball is dried. The ball can be dried, by, for example, continuing to buff the ball without applying any spray. In some implementations, a nozzle or device blows pressurized air or heated air to rapidly dry the ball.

At 412, the recorded ball color is used to determine if the ball has achieved a desired ball color. For example, a particular hue set point, a particular saturation set point, or a combination thereof can be selected for the ball. It can then be determined that if the ball is within a preset percentage of a desired set point (e.g., 80% of the desired set point), it has achieved the desired color. In some implementations, process 400 repeats 408 through 412 multiple times. For example, the first time process 400 reaches 412, the ball may be at 80% of the desired color, and the system may determine the desired color is not achieved, and return to 408, where additional buffing and spraying is performed.

At 414, when the ball has achieved the desired color, the ball is transferred to a third station, where an inspection camera performs an inspection of the ball. The inspection camera can record detailed images or video of the ball and the system assess whether or not the ball has been properly finished. In some implementations, the inspection camera assesses the ball based on red/green/blue (RGB) color readings of the ball. In some implementations, images from the inspection camera are augmented with additional data, such as weight, texture, or wetness, measured from one or more additional sensors.

At 416, if the ball does not pass inspection, it can be determined if rework is possible (418). For example, if the ball is determined to be too dark, it may be that the ball cannot be reworked. In this example, the ball can be ejected to a fail bin (420). If the ball can be reworked (e.g., its color is too light, and further spray and buffing can yield a passing ball) then process 400 may, in some instances, return to 406 with the ball being returned to the second station for rework.

Returning to 416, if the ball passes inspection a certification can optionally be applied to the passed ball at 422. The certification can be an imprint or printing of a label or number that can be used to verify the ball has been properly finished and passed inspection. The certification can include additional data for identifying the ball, or machine which performed the finishing.

At 424, the ball is ejected to a pass bin, where it can be collected with additional balls that have been finished and passed inspection.

Figure 5:
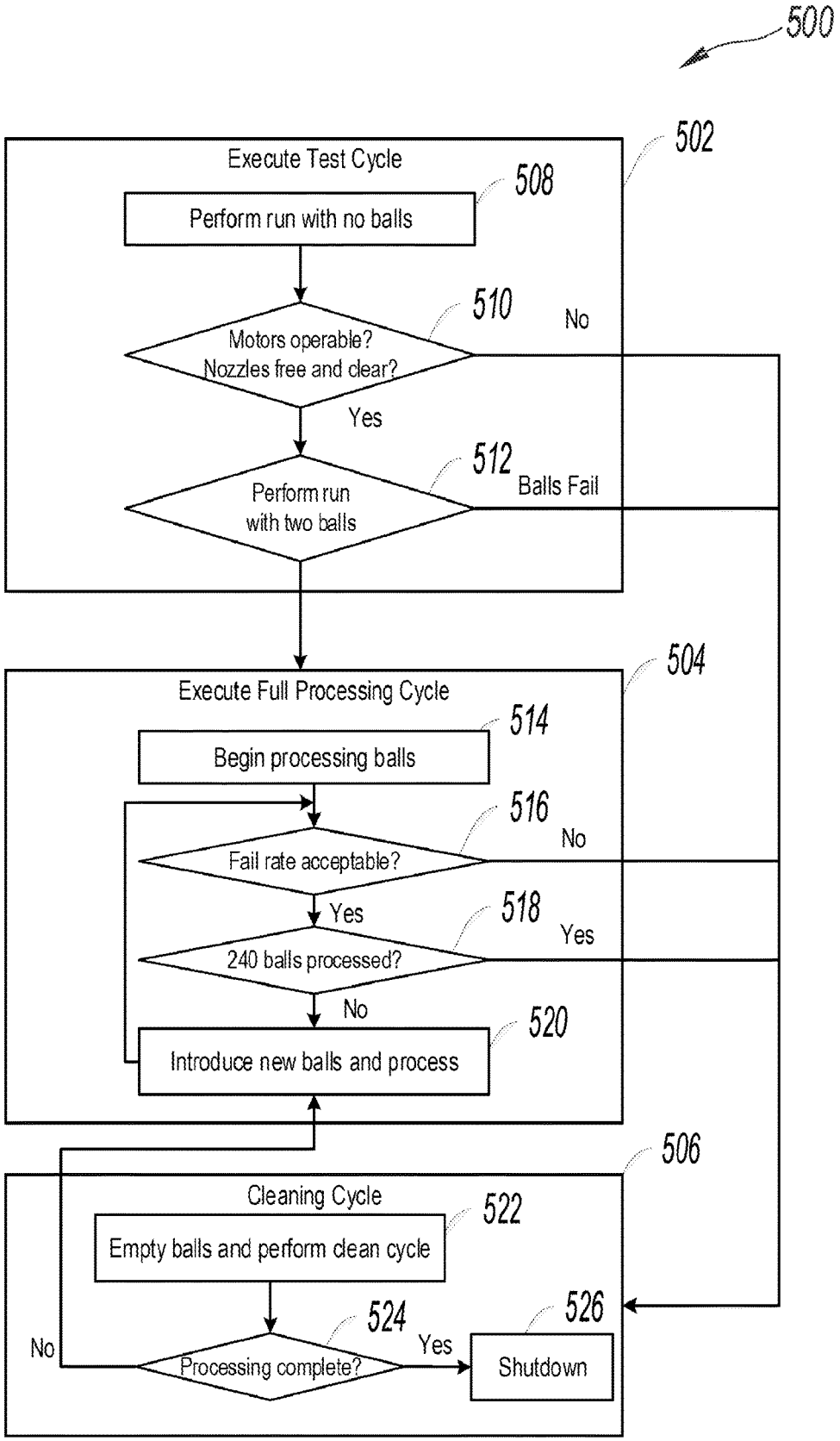
FIG. 5 is a flowchart describing an additional example process for applying finish to balls.

FIG. 5 is a flowchart describing an example process for applying finish to balls. FIG. 5 is an example process illustrated from the point of view of a ball processing system, such as processing system 100 of FIG. 1. However, it will be understood that process 500 may be performed, for example, by any other suitable system, environment, software, and hardware, or a combination of systems, environments, software, and hardware as appropriate. In some instances, process 500 may be performed by a plurality of connected components or systems. Any suitable system(s), architecture(s), or application(s) can be used to perform the illustrated operations.

At 502, a test cycle is executed. The test cycle can be performed initially, prior to full processing of balls in order to ensure proper operation of the ball processing system. At 508, the test cycle can first perform a cycle or portions of a cycle (e.g., process 400 as described with respect to FIG. 4) without any balls in the arm. This allows the system to verify spray nozzles are free and clear and internals (e.g., servomotors, motors, actuators, lights and cameras) are operating properly. If an error is detected, for example, there are motors that are not operating correctly or nozzles that are clogged (510) process 500 can proceed to the cleaning cycle 506, where the system can attempt to unclog and clear the error. If the no-ball test cycle is completed successfully with no errors, then the test cycle is repeated with two balls at 512. In some implementations, fewer, or a greater number of balls can be used at 512, to ensure a fully functioning system. If the balls in the test cycle (at 512) do not pass inspection, process 500 can again proceed to 506 where the cleaning cycle can be performed. If the balls in the test cycle pass inspection, then the full processing cycle 504 can be performed.

At 504, balls are processed to be finished (514), for example, using process 400 as described with respect to FIG. 4. During processing, a fail rate can be determined (516). In some implementations, the fail rate is calculated after each ball undergoes inspection. In some instances, the fail rate is determined periodically (e.g., every 10 balls, or every 10 minutes, etc.). If the fail rate becomes greater than a predetermined threshold, processing of the balls can be halted, or induction of new balls into the system for processing can be stopped, while the remaining balls finish processing. Once the system is clear of balls to be processed, process 500 proceeds to 506 and a cleaning cycle can be performed. Additionally the system can automatically enter a cleaning cycle periodically after a certain number of balls have been processed (518). In the illustrated example, after every 240 balls processed, the system will enter the clean cycle at 506. In some implementations, greater or fewer than 240 balls can be selected for the clean cycle periodicity. In some instances, a timeframe is used instead of a number of balls (e.g., every 15 minutes, every hour, every 3 hours of operation, etc.). Otherwise, at 520, the system continues to introduce and process new balls.

The clean cycle 506 is performed to ensure the system does not clog and continues to produce finished balls within specification. At 522, the system can verify there are no balls in the processing arm, and then perform a clean cycle. In some instances, the clean cycle includes a system spray-down with water, or a water/air mixture. In addition to the spray-down, various motors and valves in the system can be operated or cycles through different directions/speeds in order to ensure cleaning is applied to necessary surfaces within the system. Upon completion of the cleaning cycle, if further processing is required (524) process 500 can return to 516 and begin processing balls again. Otherwise, if processing is complete, the system can power down or otherwise shutdown (526).

Figure 6:
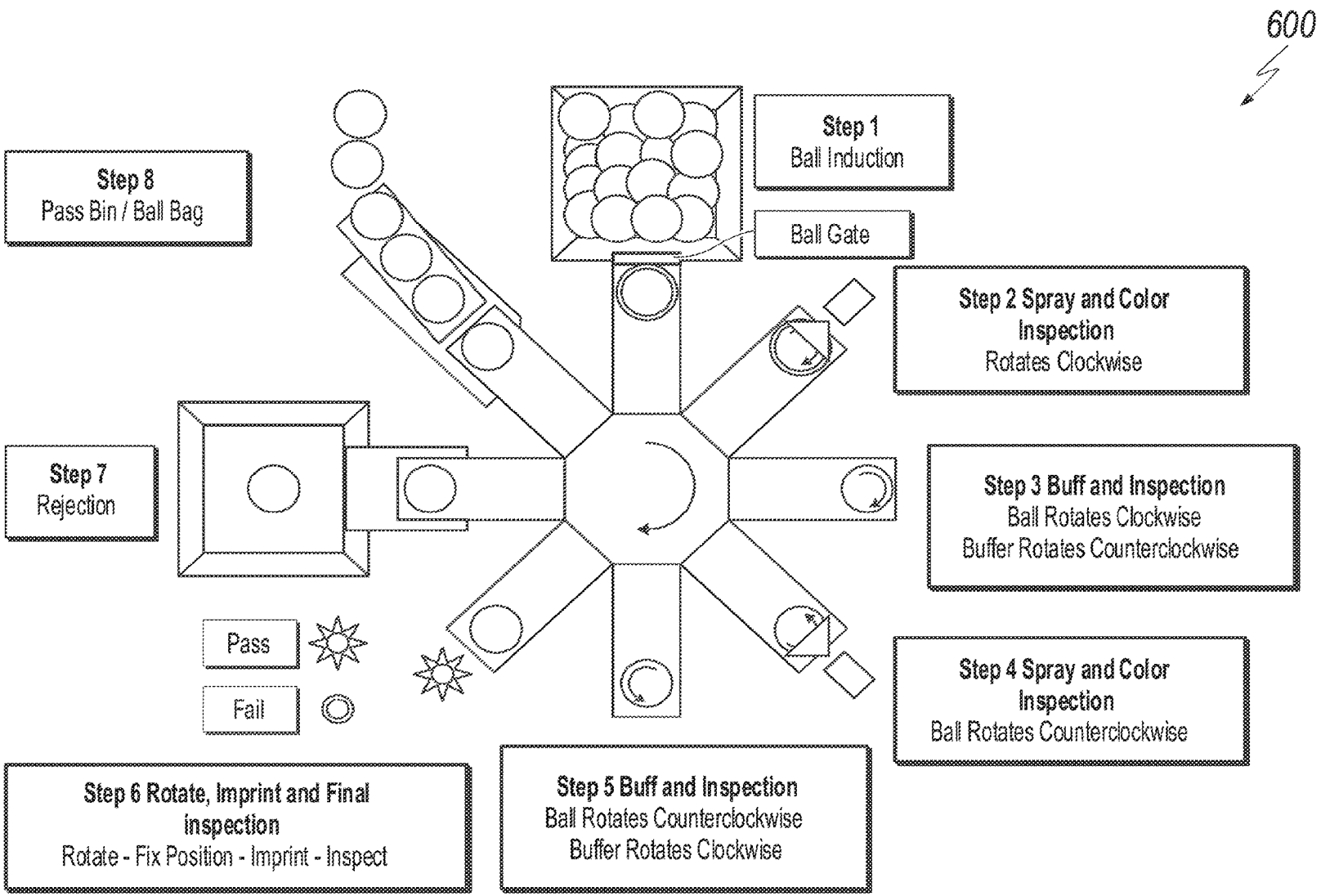
FIG. 6 is a top down view of an 8-step implementation of a ball processing system.

FIG. 6 is a top down view of an 8-step implementation of a ball processing system. FIG. 6 describes a process 600 with eight steps. In step one, balls are introduced into the system. In the illustrated system the balls are carried via a carousel arm similar to carousel arm 106 as illustrated with respect to FIG. 1. Step two shows a spray and color inspection, in which the ball is sprayed to a predetermined color threshold. At step three the ball is buffed and inspected, the ball can be rotated (e.g., by a rotating plate or motor) in a first direction, and the buffer plate can rotate in a second direction to ensure the ball is uniformly buffed. In some implementations, the ball and buffer rotate in the same direction; however, the buffer is configured to rotate faster than the ball. The process of steps two and three are repeated in steps four and five. Step six includes a final inspection, and an imprint or certification marking. At step seven, if the ball has failed inspection it is ejected into a reject bin. At step eight, if the ball has passed inspection, it is ejected into a pass bin or ball bag.

Figure 7:
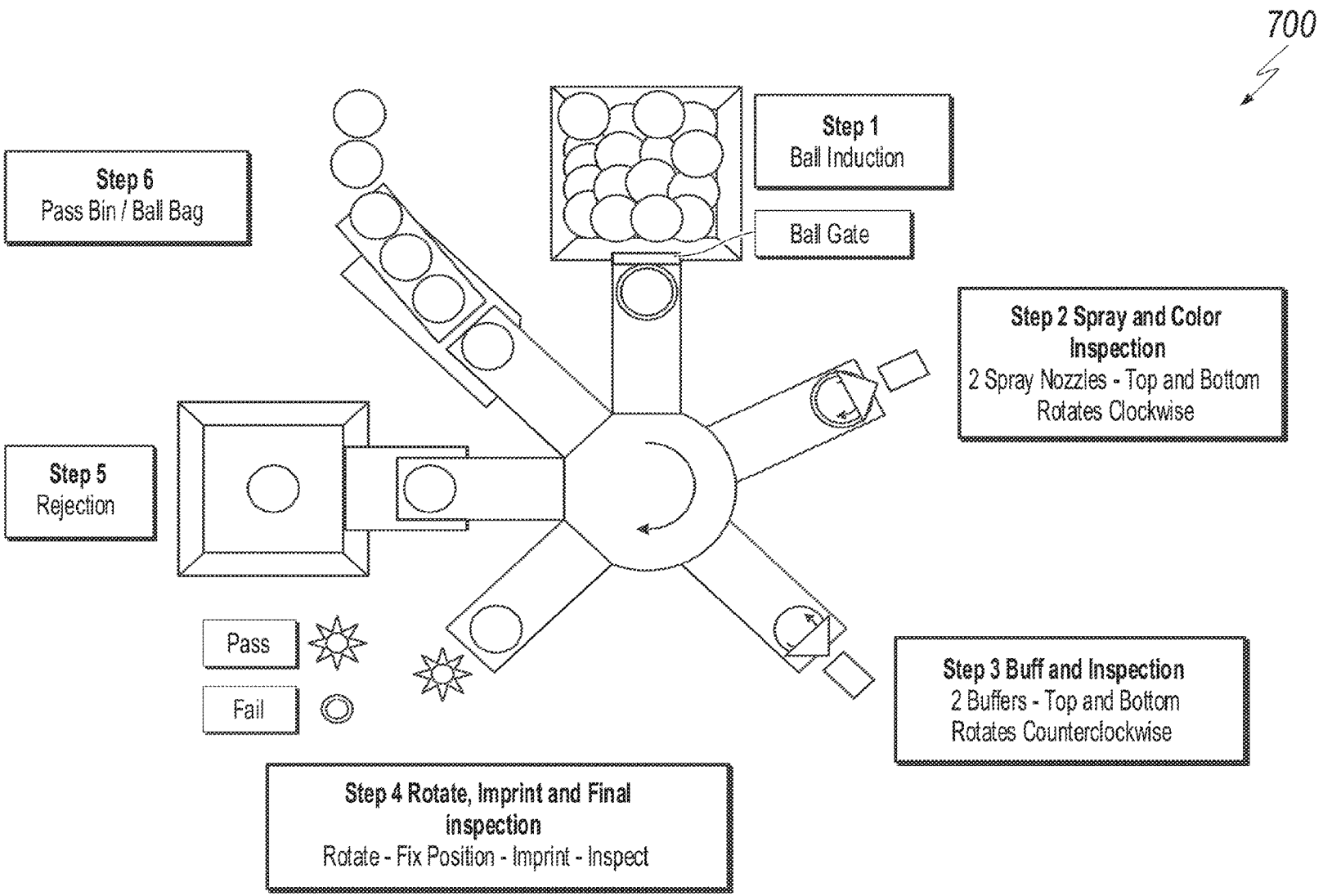
FIG. 7 is a top down view of a 6-step implementation of a ball processing system.

FIG. 7 is a top down view of a 6-step implementation of a ball processing system. 6-step process 700 is similar to the process 600 as described with respect to FIG. 6, except process 700 includes a single spray step (with multiple nozzles) and a single buff step (with multiple nozzles).

Figure 8:
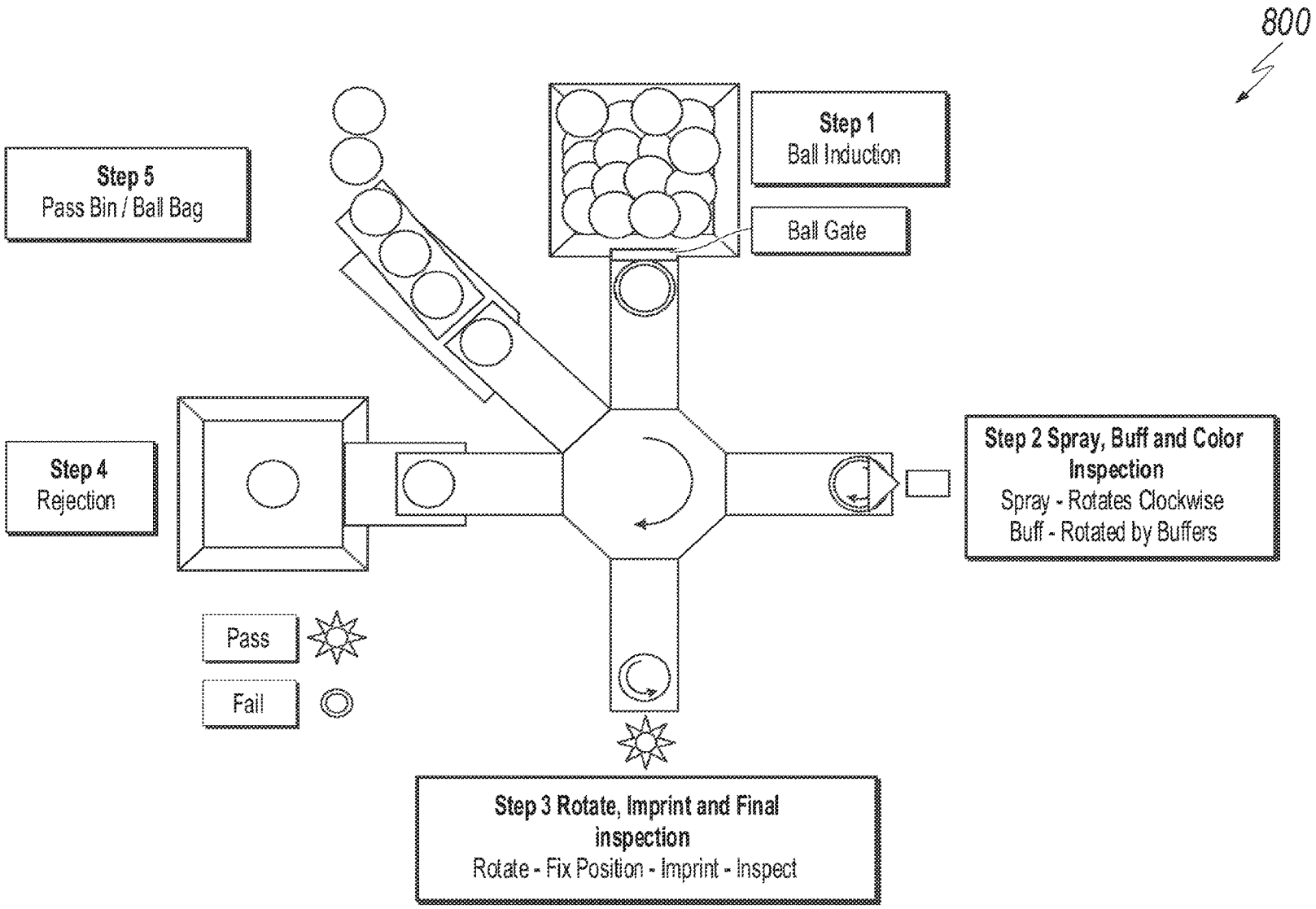
FIG. 8 is a top down view of a 5-step implementation of a ball processing system.

FIG. 8 is a top down view of a 5-step implementation of a ball processing system. The 5-step process 800 is similar to the process 600 as described with respect to FIG. 6, except process 800 features a single spray/buff/inspect step.

Figure 9:
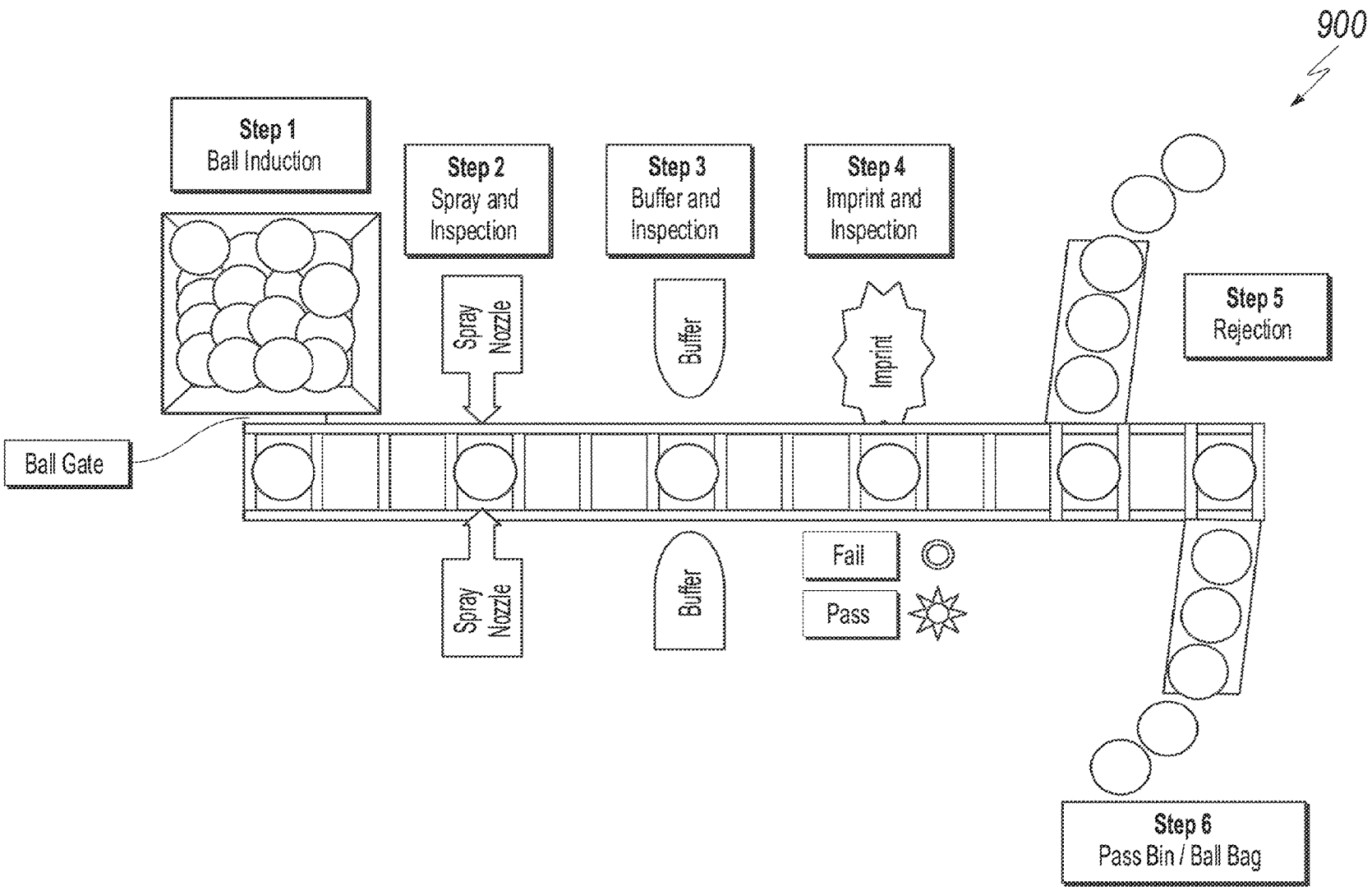
FIG. 9 is a top down view of a linear implementation of a ball processing system.

FIG. 9 is a top down view of a linear implementation of a ball processing system. Process 900 includes a conveyor arm, or belt instead of a carousel arm as described above. Each station in process 900 is arranged in a linear fashion.

Figure 10:
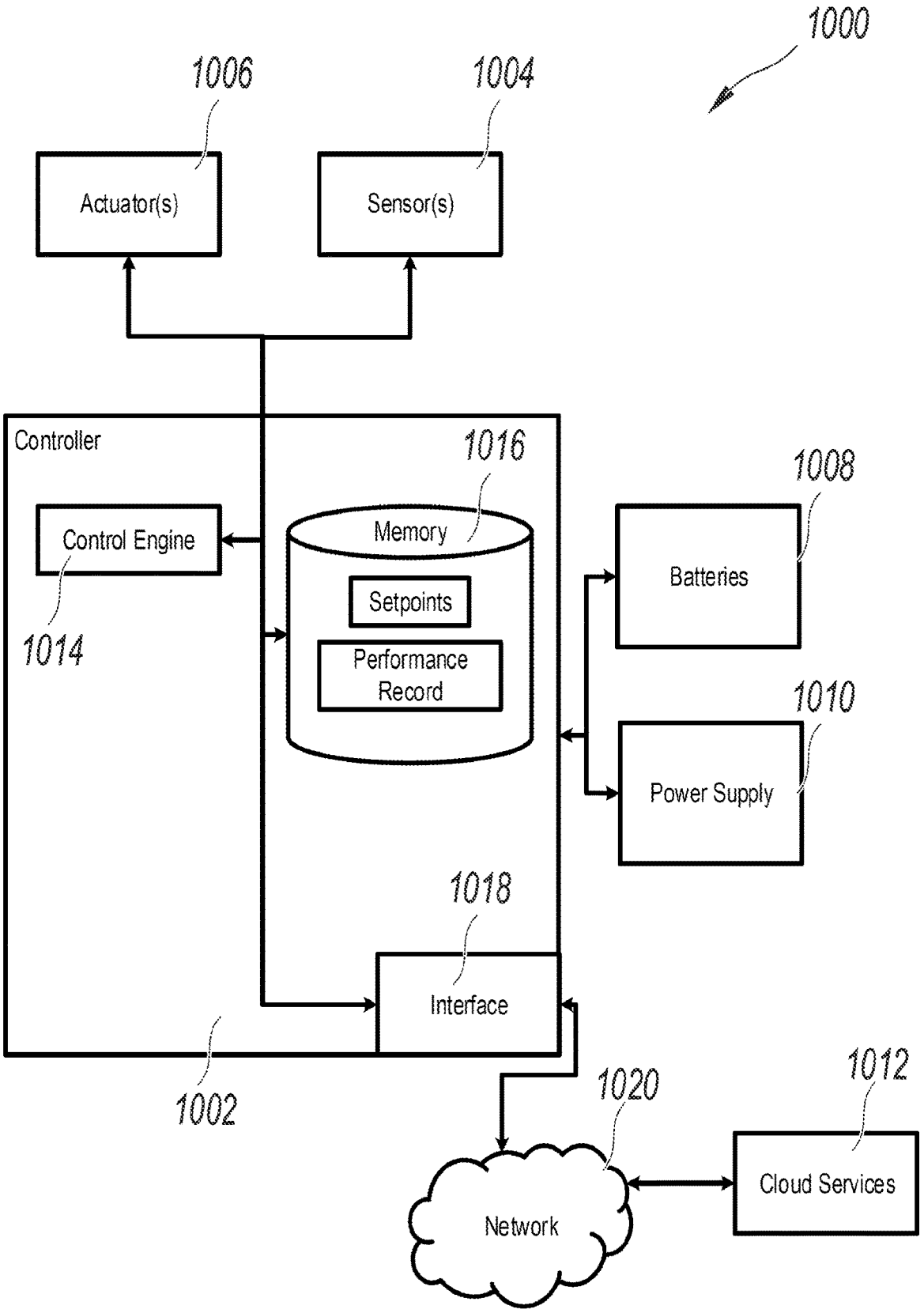
FIG. 10 is a simplified block schematic of a controller for a ball processing system.

FIG. 10 illustrates a simplified block schematic of a controller for a ball processing system. The control system 1000 includes a controller 1002, batteries 1008, a power supply 1010, sensors 1004, actuators 1006, as well as cloud services 1012. As described herein, the system 1000 can be a cloud-based system (partially or fully), while in other instances, non-cloud systems can be used. In some instances, non-cloud-based systems, such as on-premise systems, client-server applications, and applications running on one or more client devices, as well as combinations thereof, can use or adapt the processes described herein. Although components are shown individually, in some implementations, functionality of two or more components, systems, or servers can be provided by a single component, system, or server. In some instances, various applications (e.g., the control engine 1014) may be able to communicate and interact through internal and/or external communications, including through one or more channels and protocols, one or more dedicated application programming interfaces (APIs), and/or other interfaces through which information needed for the application to execute is available. For purposes of the present illustration, these portions are illustrated together for ease of description.

The controller 1002 provides control to the ball processing system via actuators 1006 and sensors 1004. The sensors 1004 can include, but are not limited to, pressure sensors, temperature sensors, cameras, encoders associated with motors, position sensors (e.g., Hall Effect sensors), flow sensors, color sensors, or light sensors. The actuators can be, but are not limited to linear actuators, motors, servomotors, electric pumps, valves, or solenoids. The controller 1002 generally receives sensed signals from sensors 1004 and issues actuation signals to actuators 1006 in order to cause the system to perform operations for processing balls (e.g., process 400 as described with reference to FIG. 4, or process 500 as described with reference to FIG. 5). The actuation signals can be determined by a control engine 1014.

The control engine 1014 can be any application, program, other component, or combination thereof that is associated with the ball processing system and is used to provide actuation signals to the actuators 1006 based on sensed signals from the sensors 1004. The control engine 1014 can access a memory 1016, which includes one or more set points as well as other logic and data. Memory 1016 of the controller 1002 can represent a single memory or multiple memories. The memory 1016 can include any memory or database module and can take the form of volatile or non-volatile memory including, without limitation, magnetic media, optical media, random access memory (RAM), read-only memory (ROM), removable media, or any other suitable local or remote memory component. The memory 1016 can store various objects or data, including set points, user and/or account information, administrative settings, password information, caches, applications, backup data, repositories storing performance history for the ball processing system, and any other appropriate information associated with the control system 1000, including any parameters, variables, algorithms, instructions, rules, constraints, or references thereto. Additionally, the memory 1016 can store any other appropriate data, such as VPN applications, firmware logs and policies, firewall policies, a security or access log, print or other reporting files, as well as others. While illustrated within the controller 1002, memory 1016 or any portion thereof, including some or all of the particular illustrated components, can be located, in some instances, remote from the controller 1002 in some instances, including as a cloud application or repository, or as a separate cloud application or repository when the controller 1002 itself is a cloud-based system. In some examples, the data stored in memory 1016 can be accessible, for example, via network 1020, and can be obtained by particular applications or functionality of the controller 1002.

Generally, the interface 1018 comprises logic encoded in software and/or hardware in a suitable combination and operable to communicate with the network 1020 and other components. More specifically, the interface 1018 can comprise software supporting one or more communication protocols associated with communications such that the network 1020 and/or interface's hardware is operable to communicate physical signals within and outside of the illustrated system 1000. Still further, the interface 1018 can allow the controller 1002 to communicate with the cloud services 1012.

Network 1020 facilitates wireless or wireline communications between the components of the system 1000 (e.g., between the controller 1002, and the cloud services 1012), as well as with any other local or remote computers, such as additional mobile devices, clients, servers, or other devices communicably coupled to network 1020, including those not illustrated in FIG. 1. In the illustrated environment, the network 1020 is depicted as a single network, but can be comprised of more than one network without departing from the scope of this disclosure, so long as at least a portion of the network 1020 can facilitate communications between senders and recipients. In some instances, one or more of the illustrated components (e.g., the memory 1016, the control engine 1014, etc.) can be included within or deployed to network 1020, or a portion thereof, as one or more cloud-based services or operations. The network 1020 can be all or a portion of an enterprise or secured network, while in another instance, at least a portion of the network 1020 can represent a connection to the Internet. In some instances, a portion of the network 1020 can be a virtual private network (VPN). Further, all or a portion of the network 1020 can comprise either a wireline or wireless link. Example wireless links can include 802.11a/b/g/n/ac, 802.20, WiMax, LTE, and/or any other appropriate wireless link. In other words, the network 1020 encompasses any internal or external network, networks, sub-networks, or combination thereof operable to facilitate communications between various computing components inside and outside the illustrated system 1000. The network 1020 can communicate, for example, Internet Protocol (IP) packets, Frame Relay frames, Asynchronous Transfer Mode (ATM) cells, voice, video, data, and other suitable information between network addresses. The network 1020 can also include one or more local area networks (LANs), radio access networks (RANs), metropolitan area networks (MANs), wide area networks (WANs), all or a portion of the Internet, and/or any other communication system or systems at one or more locations.

Cloud services can provide analytics across multiple machines, teams, and stadiums. In some implementations, the controller 1002 sends its performance record, including results of finishing, serial number of each ball finished, duration of processing, time of processing, date, and other environmental information to the cloud services 1012. The cloud services 1012, can process data received from multiple controllers across different ball processing systems and generate insights to provide for future improvements. For example, it could be determined that during colder ambient temperatures, the machines successfully process fewer balls. Based on this, one or more set points can be altered or temporarily altered based on detected ambient temperature.

The preceding figures and accompanying description illustrate example processes and computer-implementable techniques. However, system 100 (or its software or other components) contemplates using, implementing, or executing any suitable technique for performing these and other tasks. It will be understood that these processes are for illustration purposes only and that the described or similar techniques may be performed at any appropriate time, including concurrently, individually, or in combination. In addition, many of the operations in these processes may take place simultaneously, concurrently, and/or in different orders than as shown. Moreover, the described systems and flows may use processes and/or components with or perform additional operations, fewer operations, and/or different operations, so long as the methods and systems remain appropriate.

In other words, although this disclosure has been described in terms of certain embodiments and generally associated methods, alterations and permutations of these embodiments and methods will be apparent to those skilled in the art. Accordingly, the above description of example embodiments does not define or constrain this disclosure. Other changes, substitutions, and alterations are also possible without departing from the spirit and scope of this disclosure.

The invention claimed is:

1. A system for applying a finishing treatment to balls, the system comprising:

an arm configured to transport at least one ball through a plurality of stations;

a first station comprising a first actuator, the first actuator configured to permit introduction of a ball into the arm;

a second station, comprising:

a buffer configured to buff a surface of the ball and rotate the ball in place relative to the arm;

a spray nozzle configured to apply the finishing treatment to the ball; and a camera configured capture one or more images of the ball;

a third station, comprising:

an inspection camera configured to capture one or more inspection images of the ball; and a rotating plate configured to rotate the ball in place relative to the arm;

a fourth station comprising a second actuator, the second actuator configured to eject the ball from the arm; and a controller configured to determine a color of the ball based on the one or more images and the one or more inspection images, wherein the controller is configured to operate the arm, the first actuator, the second actuator, the buffer, the spray nozzle, and the rotating plate.

2. The system of claim 1, comprising a housing that at least partially encloses the arm and the plurality of stations, wherein an interior volume of the housing is illuminated with a light source.

3. The system of claim 2, wherein the light source comprises a UV-A illuminator that emits UV light in a range of 315-400 nm wavelengths.

4. The system of claim 2, comprising a position sensor mounted to the housing, the position sensor configured to provide a reference position for the arm.

5. The system of claim 1, wherein the finishing treatment is a mixture of water and one or more additives.

6. The system of claim 1, wherein the finishing treatment is a suspension.

7. The system of claim 1, wherein the first station comprises a UV-C illuminator that emits UV light in a range of 100-280 nm wavelengths and is configured to disinfect the ball.

8. The system of claim 1, wherein the arm comprises cradles to hold balls, and is configured to hold at least six balls.

9. The system of claim 8, wherein the cradles comprise an opening, and wherein the opening is configured to allow the balls to rotate within the cradle when a buffer is applied to the opening.

10. The system of claim 8, wherein the arm rotates about a vertical axis to transport the balls through the plurality of stations.

11. The system of claim 8, wherein the arm comprises a flexible belt, which rotates about a horizontal axis to transport the balls through the plurality of stations.

12. The system of claim 1, comprising a fifth station comprising a third actuator, the third actuator configured to eject the ball from the arm and into a pass bin, wherein the second actuator is configured to eject the ball from the arm and into a reject bin, and wherein, in response to determining a color of the ball is unsatisfactory, the controller actuates the second actuator when the ball is in the fourth station and in response to determining a color of the ball is satisfactory, the controller actuators the third actuator when the ball is in the fifth station.

13. The system of claim 12, comprising a labeler configured to print or imprint a label on the ball as it transits from the fourth station to the fifth station.

14. The system of claim 1, wherein the ball is a sports ball.

15. The system of claim 1, wherein the controller further operates the camera, and the inspection camera.

16. A method for applying a finish to a ball, the method comprising:

securing a ball in a holding arm configured to allow the ball to rotate about at least two perpendicular axes;

rotating the ball about a first axis, and about a second axis;

periodically spraying the finish to the ball;

buffing the ball;

after a predetermined period of time, determining, from a sensor, a color of the ball;

in response to determining the color of the ball meets a predetermined threshold, stop spraying and buffing the ball; and printing or imprinting the ball with a certification.

17. The method of claim 16, comprising:

in response to determining a color of the ball does not meet the predetermined threshold, re-spraying and re-buffing the ball.

18. The method of claim 17, comprising:

following re-spraying and re-buffing, determining a second color of the ball; and in response to determining the second color of the ball does not meet the predetermined threshold, ejecting the ball into a reject bin.

19. The method of claim 16, comprising:

prior to spraying the ball, irradiating the ball with UV-C light with wavelengths in a range 100-280 nm to disinfect the ball.

20. The method of claim 16, wherein the ball is a sports ball.

21. The method of claim 16, wherein the finish is a mixture of water and one or more additives.

22. The method of claim 16, wherein the finish is a suspension.

23. The method of claim 16, comprising:

while determining the color of the ball, irradiating the ball with a light source comprising a UV-A illuminator that emits UV light in a range of 315-400 nm wavelengths.

24. The method of claim 16, wherein the holding arm comprises cradles to hold balls, and is configured to hold at least six balls.

* * * * *